US006965315B2

(12) United States Patent
Ikeda

(10) Patent No.: US 6,965,315 B2
(45) Date of Patent: Nov. 15, 2005

(54) ANTI-THIEF SECURITY SENSOR ASSEMBLY

(75) Inventor: Hiroyuki Ikeda, Otsu (JP)

(73) Assignee: Optex Co., Ltd., Shiga (JP)

( * ) Notice: Subject to any disclaimer, the term of this patent is extended or adjusted under 35 U.S.C. 154(b) by 215 days.

(21) Appl. No.: 10/409,249

(22) Filed: Apr. 8, 2003

(65) Prior Publication Data

US 2003/0193397 A1 Oct. 16, 2003

(30) Foreign Application Priority Data

Apr. 11, 2002 (JP) ..... 2002-108888

(51) Int. Cl.[7] ..... G08B 13/18
(52) U.S. Cl. ..... 340/556; 250/221; 356/399
(58) Field of Search ..... 340/555–557, 340/541; 250/221; 356/372, 375, 399

(56) References Cited

U.S. PATENT DOCUMENTS

| | | | | | |
|---|---|---|---|---|---|
| 3,653,021 | A | * | 3/1972 | Litman et al. | 340/556 |
| 3,752,978 | A | * | 8/1973 | Kahl et al. | 340/556 |
| 4,186,388 | A | * | 1/1980 | Robinson | 340/556 |
| 4,282,430 | A | * | 8/1981 | Hatten et al. | 250/221 |
| 4,347,438 | A | * | 8/1982 | Spielman | 250/221 |
| 4,626,683 | A | * | 12/1986 | Van Zeeland | 250/221 |
| 4,644,329 | A | * | 2/1987 | Brueske | 340/556 |
| 4,650,989 | A | * | 3/1987 | Frigon | 340/557 |
| 5,198,799 | A | * | 3/1993 | Pascale | 340/556 |
| 5,334,972 | A | * | 8/1994 | Sugimoto et al. | 340/556 |
| 5,812,058 | A | * | 9/1998 | Sugimoto et al. | 340/556 |
| 6,186,639 | B1 | | 2/2001 | Givet | |

FOREIGN PATENT DOCUMENTS

| | | |
|---|---|---|
| EP | 0 507 273 | 10/1992 |
| EP | 0 821 329 | 1/1998 |
| EP | 0 928 923 | 7/1999 |
| EP | 1 045 353 | 4/2001 |
| JP | 1-112482 | 5/1989 |
| JP | 4-295739 | 11/1992 |

* cited by examiner

*Primary Examiner*—Thomas Mullen

(57) ABSTRACT

To provide an anti-thief security sensor assembly in which the angle of an optical unit can be adjusted over a wide range without increasing the size thereof and in which an optical axis can easily be adjusted, the security sensor assembly includes an optical unit (14) mounted at its lateral sides on a support member (9) of a device body (4) for rotation about a horizontal pivot axis (24) for projecting or receiving a detecting wave. A drive gear (29) is rotatably mounted on the support member (9) and positioned laterally of the optical unit (14) and adapted to be manually turned. A driven gear (39) is mounted on a lateral side of the optical unit (14) and is drivingly meshed with the drive gear (29). The driven gear (39) is rotatable together with the optical unit (14) about a horizontal pivot axis (11).

10 Claims, 6 Drawing Sheets

ANTI-THIEF SECURITY SENSOR ASSEMBLY

BACKGROUND OF THE INVENTION

1. Field of the Invention

The present invention generally relates to an anti-thief security sensor assembly and, more particularly, to the anti-thief security sensor assembly that is used to form a part of a security system for detecting an intruder when he or she traverses across the path of travel of a detecting wave, for example, an infrared beam.

2. Description of the Prior Art

A security system of this kind is currently generally available in separate and integrated types. The separate type is of a structure in which a beam projecting unit and a beam receiving unit, each forming a security sensor assembly, are installed at opposite ends of a rectilinear guard area spaced an appropriate distance from each other with their optical axes aligned with each other; and the integrated type is of a structure in which, formed as a security sensor assembly, a pair of beam projecting and receiving units including respective sets of a beam projector and a beam receiver are installed at opposite sites to have their optical axes oriented towards a guard area. Regardless of the type, the security system now available in the art has a monitoring coverage ranging from a short rectilinear distance to a long rectilinear distance of, for example, a few hundred meters and generally requires the beam projector and the beam receiver to be optically accurately aligned with each other. In order for the optical axis between the beam projector and the beam receiver to be accurately adjusted, the security system is provided with a fine adjustment mechanism for adjusting one or both the horizontal angle and the vertical angle.

The fine adjustment mechanism hitherto employed in the anti-thief security system will be discussed in detail with reference to FIGS. 5A and 5B. As shown in FIG. 5A, an optical unit 50 having a downwardly extending working tongue 59 formed therewith, or otherwise rigidly secured thereto, is supported by two arms 52 of a generally U-shaped support frame 51 by means of respective coaxial support pins 53 so that the optical unit 50 can tilt about a common axis between the coaxial support pins 53. As shown in FIG. 5B, a torsion spring 54 is coiled around the support pin 53 and has its ends engaged with the adjacent arm 52 and a portion of the optical unit 50 to thereby urge the optical unit 50 in the direction indicated by the arrow P, that is, clockwise about the common axis between the support pins 53.

The support member 51 has a connecting base connecting the arms 52 together and having a stationary tongue 57 provided thereon so as to extend in a direction conforming to the direction in which the arms 52 extends. An adjustment screw 58 threadingly extends through an internally threaded hole defined in the stationary tongue 57 so as to terminate in abutment with the working tongue 59 rigid or integral with the optical unit 50. Since the optical unit 50 is urged in the clockwise direction P by the action of the torsion spring 54 as described above, the downwardly extending working tongue 59 is held in engagement with a tip of the adjustment screw 58 opposite to the screw head.

The conventional fine adjustment mechanism of the structure described above is of a design wherein as the adjustment screw 58 is turned to advance from a position shown by the phantom line, the tip of the adjustment screw 58 then held in engagement with the working tongue 59 pushes the working tongues 59 in a direction rearwardly, accompanied by turn of the optical unit 50 in a counterclockwise direction about the common axis between the support pins 53 as viewed in FIG. 5B. So to speak, turn of the adjustment screw 58 in a first direction results in the optical unit 50 being tilted against the resilient force of the torsion spring 54, but turn of the adjustment screw 58 in a second direction counter to the first direction allows the optical unit 50 to tilt as biased by the torsion spring 54. Thus, with the conventional fine adjustment mechanism, it is possible to adjust the angle of the optical unit in the vertical direction about the common axis between the support pins 53 in response to turn of the adjustment screw 58.

Adjustment of the angle of the optical unit in the vertical direction by means of the adjustment screw 58 for alignment of the optical axis is carried out while an attendant worker looks through view ports of a sighting device. For adjustment of the angle of the optical unit in the horizontal direction perpendicular to the vertical direction is often carried out by turning the support member 51 with hands in a right or left direction, which member 51 is rotatably mounted on a device body. It is to be noted that in the case the optical unit 50 discussed above is a beam projector, it includes a beam projecting element and at least one reflecting mirror or lens for reflecting infrared rays of light, projected from the projecting element, so as to project it as an infrared beam traveling in a predetermined direction, but where it is a beam receiver, it includes a beam receiving element and a reflecting mirror or condensing lens.

The conventional fine adjustment mechanism of the structure discussed above has a problem in that if the angle of tilt of the optical unit in the vertical direction is desired to be large, for example, within ±45° about the axis of tilt with respect to a reference position, the adjustment screw must have an increased length appropriate to the large angle of tilt of the optical unit. The use of the adjustment screw of the increased length results in increase in size, particularly the depth, of the housing structure and, in turn, results in unnecessary increase of the size of the anti-thief security device as a whole along with requirement to perform a job of adjustment of the optical axis for an increased length of time.

Also, considering that the adjustment screw 58 is so positioned that the attendant worker trying to perform the adjustment with a screwdriver is required to occupy a position in front of the optical unit 50 where the optical path of the optical unit 50 is defined. Accordingly, when the attendant worker attempts to performs a job of aligning the optical axis while looking through the view ports of the sighting device, one or both of the optical path traveling forwards from the optical unit and the field of view of the sighting device would be disturbed by his or her hands then manipulating the screwdriver, enough to make it difficult for the attendant worker to determine the orientation of the optical system and/or to determine the optimum tilt angle of the optical system that is generally done by monitoring the level of the incident infrared rays of light. For these reason, the attendant worker is often forced to take a labored attitude in such a way as to avoid his hand disturbing the path of travel of the infrared rays of light and/or the field of view of the sighting device while looking through the sighting device, thereby requiring a laborious work which in turn results in reduction in work efficiency.

In addition, since it is difficult to coordinate the operating direction for the angle adjustment, that is, the direction of turn of the adjustment screw 58 with the direction of tilt of the optical unit 50, the attendant worker often misapprehend the direction in which the adjustment screw 58 has to be turned, resulting in reduction in work efficiency as well. By way of example, when the optical unit 50 is desired to be tilted a certain angle in the clockwise direction P so that the optical unit 50 can be oriented upwards, it would be difficult to determine the direction in which the adjustment screw 58 has to be turned to turn the optical unit 50 in the clockwise direction P. In particular, considering that the beam projecting unit or the beam receiving unit now in use utilizes mostly a pair of optical units 50 positioned one above the other and in such case the optical units 50 are set in position having been tilted in respective directions opposite to each other, the adjustment screws 58 associated with the respective optical units 50 are required to be turned in respective directions opposite to each other so that the optical units 50 can be tilted in the directions opposite to each other. Accordingly, it is quite often that the attendant worker tends to misapprehend the respective directions in which the adjustment screws 58 have to be turned.

SUMMARY OF THE INVENTION

The present invention has been devised in view of the foregoing problems and is intended to provide an anti-thief security sensor assembly in which the angle of an optical unit can be adjusted over a relatively wide range without the size of the assembly being increased, and also which allows an attendant worker to perform easily a required job of adjusting the optical axis while looking through a sighting device.

In order to accomplish the foregoing object, the present invention provides a security sensor assembly for detecting an intruder by means of a detecting wave, which includes a support member fitted to a device body, an optical unit mounted at its lateral sides on the support member for rotation about a horizontal pivot axis for projecting or receiving the detecting wave, and a drive gear rotatably mounted on the support member and positioned laterally of the optical unit and adapted to be manually turned, and a driven gear mounted on a lateral side of the optical unit and drivingly meshed with the drive gear. The driven gear is rotatable together with the optical unit about the horizontal pivot axis.

According to the present invention, rotation of the drive gear results in turning of the optical unit by means of the driven gear meshed with the drive gear. Accordingly, even if the angle over which the optical unit can be turned is chosen to be large, the drive mechanism made up of the drive and driven gears will not increase in size. Also, since the drive gear necessary to manually turn the optical unit is positioned laterally of the optical unit, there is no possibility that the hand then manipulating the drive gear will intercept the path of travel of the light beam and/or the field of view of a sighting device and, therefore, the attendant worker can readily and easily perform the adjustment to align the optical axis in a comfortable posture while looking through the sighting device. Since the angle of the optical unit can be varied by turning the drive gear with hands, the adjustment is extremely easy to perform as compared with that performed by the use of the screwdriver to drive the adjustment screw.

In one preferred embodiment of the present invention, the drive gear is an externally threaded gear and the driven gear is an internally threaded gear. According to this feature, since the drive gear and the driven gear meshed with the drive gear can be turned together in the same direction, that is, the direction of the drive gear being manually turned matches with the direction of the optical unit being rotated or tilted, there is no possibility that the attendant worker performs an erroneous operation to rotate the optical unit in the wrong direction and, therefore, a job of adjusting the angle of the optical unit can be efficiently performed in the matter of minutes.

In another preferred embodiment of the present invention, a stopper piece is provided on a lateral side of the optical unit, and the support member has an engagement slot defined therein. The engagement slot receives the stopper piece therein while allowing the stopper piece to be exposed laterally outwardly from the optical unit. The stopper piece and the engagement slot cooperate with each other to define an angle over which the optical unit can be rotated about the horizontal pivot axis. According to this feature, the attendant worker when ascertaining with his or her naked eyes the position of the stopper piece within the engagement slot can understand at a glance the approximate vertical or tilt angle at which the optical unit being then adjusted is held.

Preferably, the drive gear is rotatably supported by the support member and is coaxially provided on a vertical angle adjusting knob having an outer peripheral surface knurled to have surface indentations. According to this feature, by manually turning the adjusting knob having the knurled outer peripheral surface, the vertical angle of the optical unit can easily be adjusted.

Also preferably, the support member is mounted on the device body for rotation about a vertical pivot axis. This arrangement advantageously makes it possible for the optical unit to be turned left and right about the vertical pivot axis to thereby adjust the horizontal angle of the optical unit.

The support member may be of a generally U-shaped configuration having a base plate and a pair of support arms extending from opposite ends of the base plate at right angles thereto, respectively, and the optical unit is supported by the support arms. This feature advantageously facilitates simplification of the structure of the support member.

In a further preferred embodiment, the base plate has an internally threaded gear and a horizontal angle adjusting knob is supported by the device body for rotation about the vertical pivot axis. This horizontal angle adjusting knob may have an outer peripheral surface knurled to provide surface indentations, and an externally threaded gear is provided coaxially on the horizontal angle adjusting knob and drivingly meshed with the internally threaded gear of the base plate. Also, since change of any of the horizontal and vertical angles of the optical unit 14 is accomplished by means of the adjusting knobs 8 and 13, the beam projecting device P embodying the present invention is extremely easy to operate as compared with the conventional device requiring the use of a screwdriver to turn the adjustment screw and, thus, a quick manipulation of the beam projecting device P is possible. Also, the drive gear and the driven gear may be employed in the form of an externally threaded gear.

BRIEF DESCRIPTION OF THE DRAWINGS

In any event, the present invention will become more clearly understood from the following description of a preferred embodiment thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

Hereinafter, an anti-thief security sensor assembly according to preferred embodiments of the present invention will be described in detail.

Figure 1:
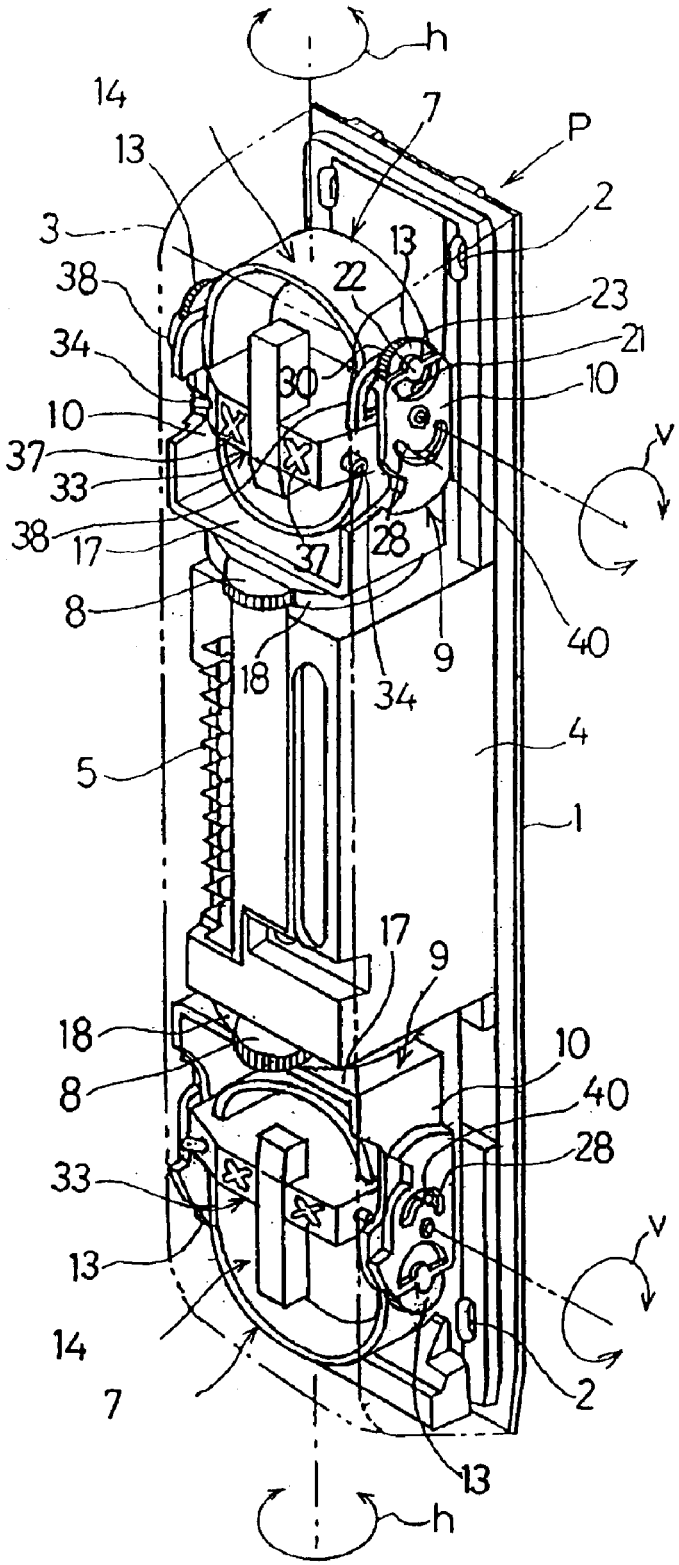
FIG. 1 is a perspective view showing a beam projecting device, which forms a part of an anti-thief security sensor assembly, according to a first preferred embodiment of the present invention, the beam projecting device being shown with a front cover removed.

Referring first to FIG. 1, there is shown a beam projecting device P forming a part of an anti-thief security sensor assembly according to a first preferred embodiment of the present invention, with a front cover removed. As shown therein, the beam projecting device P is made up of a sensor casing which includes a generally rectangular mounting base 1 adapted to be fixedly secured to a support surface such as a wall of a building with its longitudinal axis oriented upwardly and downwardly, i.e., in a vertical direction, and a front cover 3 removably fitted to the mounting base 1 through a plurality of fixture holes 2 of the mounting base for protecting a sensor circuit arrangement.

A terminal carrier casing 4, which is formed as a device body, having a plurality of terminal elements 5 is mounted on a portion of the mounting base 1 generally intermediate of the length of the latter and encloses therein an electronic circuit such as a circuit necessary to generate a beam signal to be projected. Upper and lower beam projectors 7 are mounted on respective upper and lower ends of the terminal carrier casing 4 for rotation about a vertical pivot axis (not shown) in a direction shown by the arrow h. The upper and lower beam projectors 7 are positioned in a fashion inverted relative to each other. For each of the upper and lower beam projectors 7, a respective horizontal angle adjustment knob 8 having its outer peripheral surface knurled to provide surface indentations is rotatably mounted on the corresponding end (an upper or lower end) of the terminal carrier casing 4 so that as the horizontal angle adjustment knob 8 is manually turned in a right or left direction, the respective beam projector 7 can be turned in a direction leftwards or rightwards about the vertical pivot axis to adjust the horizontal angle (the angle defined in the direction shown by the arrow h) of the corresponding beam projector 7.

Figure 2:
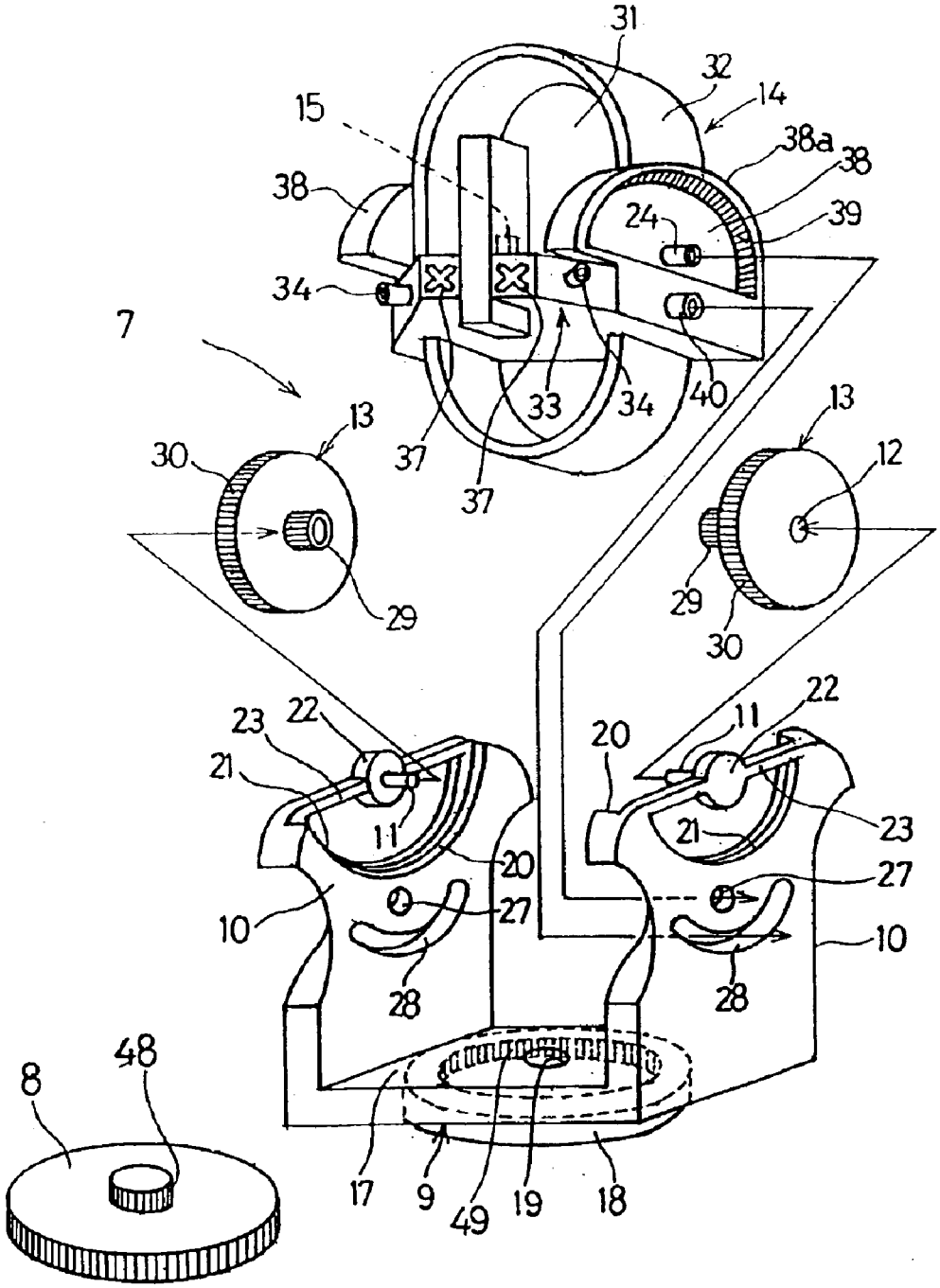
FIG. 2 is an exploded view of one of beam projectors employed in the beam projecting device shown in FIG. 1.

FIG. 2 illustrates an exploded view of one of the beam projectors 7 discussed above. As shown therein, the beam projector 7 includes a generally U-shaped support bracket 9 made up of a base plate 17 and a pair of plate-like arms 10 extending from opposite ends of the base plate 17 at right angles thereto, left and right vertical angle adjusting knobs 13 rotatably supported by the respective arms 10, and an optical unit 14 for projecting a detecting wave in the form of, for example, an infrared beam. Each of the arms 10 has its inner surface formed with a support pin 11 extending horizontally. The vertical angle adjusting knobs 13 have respective mounting holes 12 defined therein and are rotatably mounted on the respective arms 10 while the support pins 11 engage in the associated mounting holes 12 and, accordingly, the vertical angle adjusting knobs 13 can be turned about a common horizontal axis defined by the support pins 11.

The base plate 17 of the U-shaped support bracket 9 has an undersurface provided with a boss 18 and also has a mounting hole 19 defined therein which extends completely across the thickness of the base plate 17 and the boss 18 for rotatably receiving a vertical pivot pin (not shown) of the terminal carrier casing 4. A portion of the inner surface of an upper free end of each of the arms 10 is formed with a generally semicircular recess 20 for receiving therein the corresponding vertical angle adjusting knob 13 that is rotatably mounted on the respective support pin 11, and a side wall of the respective semicircular recess 20 is depleted to define a generally semicircular opening 21. Accordingly, a relatively small round pin support 22 formed integrally with the support pin 11 is supported by an intermediate portion of a thin-walled, elongated support piece 23. Each of the arms 10 is formed with a bearing hole 27 defined therein at a location below the associated recess 20 for rotatably receiving therein a corresponding one of pivot pins 24 that are formed with the optical unit 14 so as to protrude laterally outwardly therefrom. Each of the arms 10 is also formed with a generally arcuate engagement slot 28 defined therein at a location below the bearing hole 27, of which center of curvature is concentric with the respective bearing hole 27. It is to be noted that the pivot pins 24 defines a horizontal pivot axis about which the optical unit 14 can tilt up and down.

Each of the vertical angle adjusting knobs 13 has its inner central portion formed with a drive gear 29 of a relatively small outer diameter, in the form of an externally threaded gear, such that the drive gear 29 protrudes laterally from the inner central portion of the adjusting knobs 13, and also has an outer peripheral surface knurled to provide surface indentations 30 effective to avoid any possible relative slippage between a finger of an attendant worker and the respective vertical angle adjusting knob 13.

The optical unit 14 in each of the beam projectors 7 includes a mirror casing 32 having its bottom surface formed with a beam emitting mirror 31 that has a substantially parabolic light reflecting surface. The beam emitting mirror 31 is operable to reflect infrared rays of light, emitted from a beam projecting element 15 which is supported forwardly of the beam emitting mirror 31, to thereby form an infrared beam traveling in a predetermined direction. A sighting device 33 is provided at a location somewhat below an intermediate portion of space within the mirror casing 32 in a direction conforming to the longitudinal direction of the mounting base 1 (FIG. 1). This sighting device 33 has a front surface provided with left and right eyepiece windows (view ports) 34 and, also, left and right objective windows (sighting windows) 37 and has its interior provided with sighting mirrors (not shown) for defining an optical path between the eyepiece windows 34 and the objective windows 37.

Figure 3:
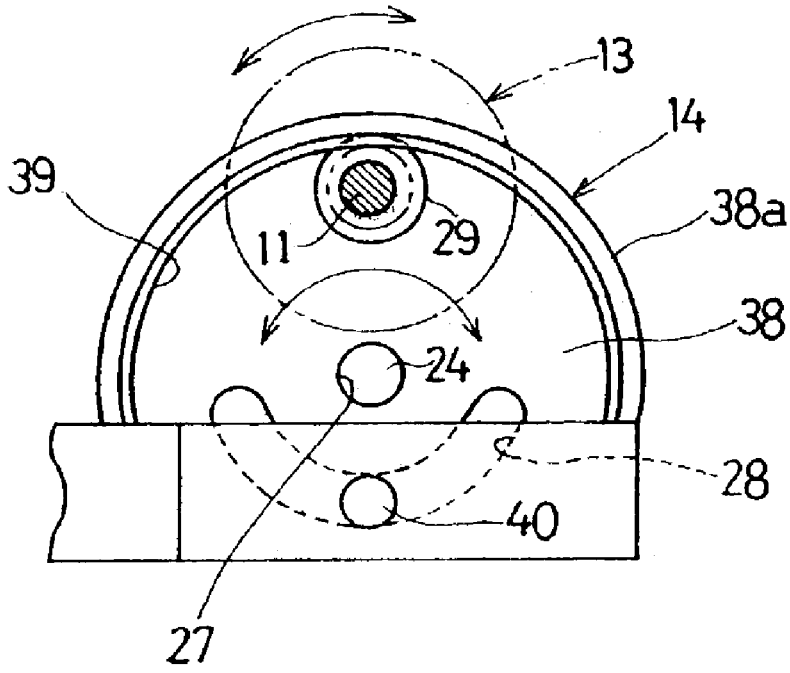
FIG. 3 is a fragmentary right-hand side view of a portion of the beam projecting device of FIG. 1, showing the relationship in position between an optical unit and an angle adjustment knob for adjustment of the vertical angle of the optical unit.

Also, the optical unit 14 has a passive portion 38 formed integrally with an outer surface of each of opposite sides of the mirror casing 32. This passive portion 38 is of a generally semicircular configuration concentric with the corresponding pivot pin 24 and has a peripheral wall 38*a* in an outer peripheral edge thereof. An inner surface of the peripheral wall 38*a* of the passive portion 38 is formed with a driven gear 39 such as an internally threaded gear. As shown in FIG. 3, when the optical unit 14 is mounted on the U-shaped support bracket 9 with a pair of the vertical angle adjusting knobs 13 rotatably mounted on the associated support pins 11 in the arms 10 and, also, with the pivot pins 24 of the optical unit 14 rotatably received in the associated bearing holes 27 in the arms 10, the drive gears 29 of the respective vertical angle adjusting knobs 13 are meshed respectively with the driven gears 39 in the optical unit 14 and, at the same time, pin-shaped stopper pieces 40 so formed in the opposite sides of the optical unit 14 as to protrude laterally outwardly therefrom are inserted into the associated arcuate engagement slots 28 in the arms 10 of the U-shaped support bracket 9 so as to be exposed to the outside.

Thus, it will readily be seen that as the vertical angle adjusting knobs 13 are manually turned, the optical unit 14 can be rotated, i.e., tilted up and down (in a direction shown by the arrow v in FIG. 1) about the horizontal pivot axis defined by the pivot pins 24 because of the drive gear 29 meshed with the driven gear 39 integral with the optical unit 14. Accordingly, turn of the vertical angle adjusting knobs 13 results in adjustment of the vertical angle of the optical unit 14 in the direction shown by the arrow v in FIG. 1. It is to be noted that the angle over which the optical unit 14 can be pivoted about the horizontal pivot axis is determined by the length of the arcuate engagement slots 28 cooperatively engaged with the associated stopper pieces 40.

It is to be noted that the mechanism for turning the support bracket 9 about the vertical pivot axis in response to turn of the horizontal angle adjusting knob 8 shown in FIG. 1 is substantially similar to the mechanism for turning the optical unit 14 about the horizontal pivot axis in response to turn of the vertical angle adjusting knobs 13. More specifically, as shown in FIG. 2, the horizontal angle adjusting knob 8 has its center portion formed with a drive gear 48 that is drivingly meshed with a driven gear 49 defined in an inner peripheral surface of an outer ring wall of the boss 18 formed integrally with the support bracket 9. Thus, it will readily be seen that turn of the horizontal angle adjusting knob 8 causes the drive gear 48 to drive the driven gear 49 and, hence the support bracket 9 about the vertical pivot axis coaxial with the mounting holes 19.

Figure 6:
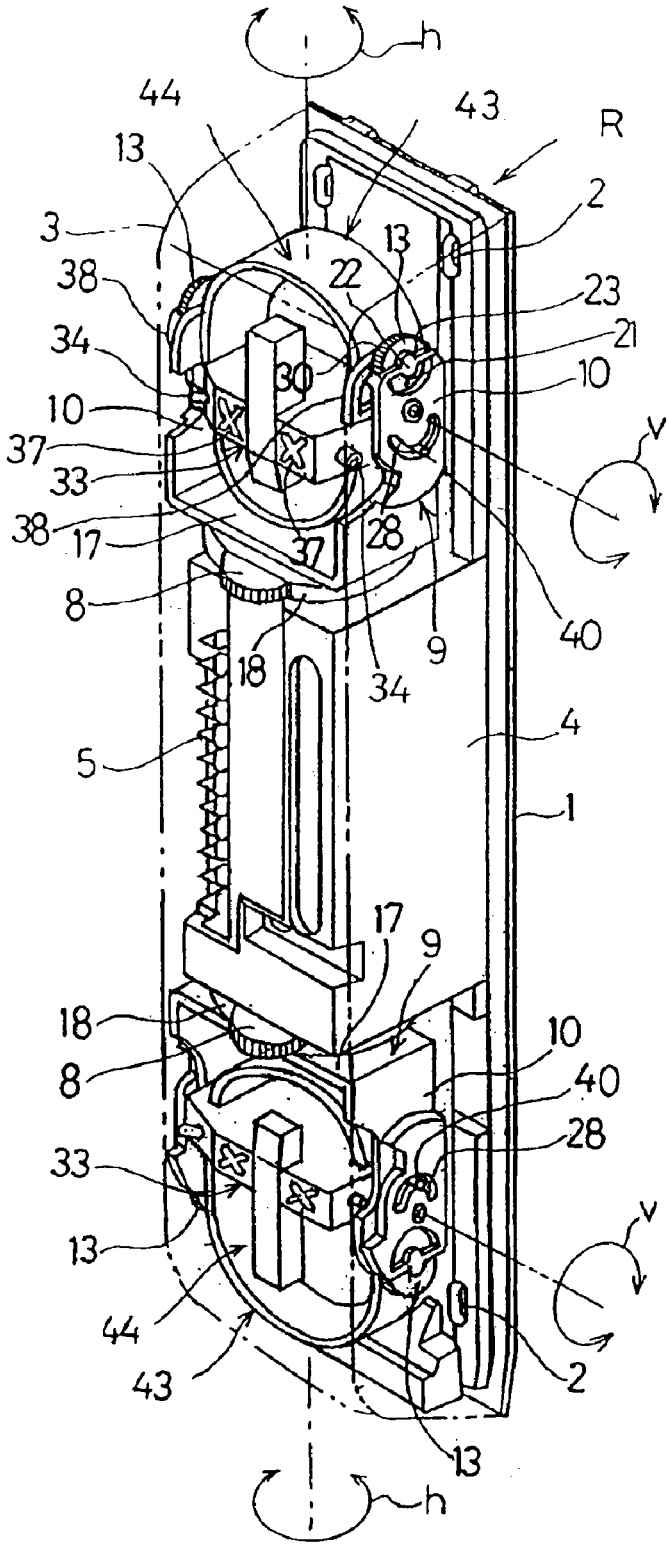
FIG. 6 is a perspective view of a beam receiving device.
Figure 7:
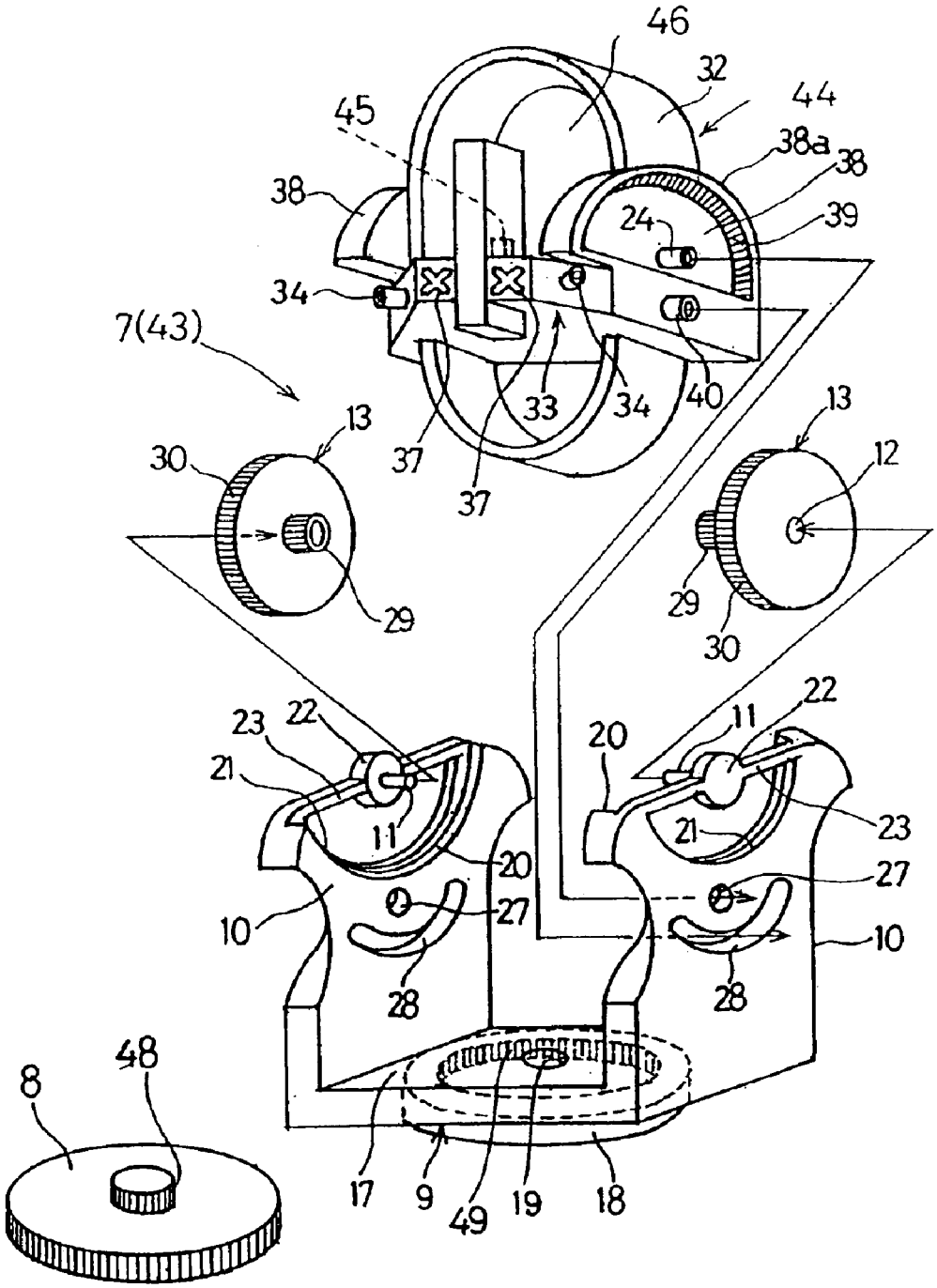
FIG. 7 is an exploded view of a beam receiver of FIG 6.

While the foregoing description is directed to the beam projecting device P of the anti-thief security system that forms a part of the anti-thief security sensor assembly, a beam receiving device R of the anti-thief security system that forms another part of the anti-thief security sensor assembly is of a structure substantially similar to the above discussed structure of the beam projecting device P, as shown in FIGS. 6 and 7 where the same reference numbers are used for the same components, except for the following differences. Specifically, the beam receiving device R makes use of a beam receiver 43 in place of the beam projector 7 used in the beam projecting device P shown in FIG. 2; an optical unit 44 of the beam receiver 43 makes use of a condensing mirror 46 in place of the beam emitting mirror 31 used in the beam projecting device P; a light receiving element 45 such as a phototransistor is employed in place of the light projecting element 15 used in the beam projecting device P and is disposed in alignment with a focal point of the condensing mirror 46; and the infrared beam projected from the beam projecting device P is received by the light receiving element 45 after having been reflected by the condensing mirror 46. The beam projecting device P and the beam receiving device R are supported to face each other by support walls or poles at opposite ends of the rectilinear guard area, respectively, with their optical axes aligned with each other, to thereby form the anti-thief security system of a beam projecting and receiving type.

With the anti-thief security sensor assembly of the structure described above, when a fine adjustment of the optical axis is desired to be performed at the time of installation or servicing of the security sensor assembly, the front cover 3 removably mounted on the mounting base 1 of the beam projecting device P shown in FIG. 1 is first removed. Thereafter, while looking through one of the eyepiece windows 34 of the sighting device 33, the attendant worker has to manually manipulate the horizontal or vertical angle adjusting knob 8 or 13 to thereby adjust the horizontal or vertical angle of the optical unit 14 until an image of the beam receiver 43 of the beam receiving device R then cast on the sighting mirror within the sighting device 33 is aligned with the center of the objective window 37. The adjustment of the optical axis completes in this way.

With the beam projecting device P designed in accordance with the foregoing embodiment, the adjustment to align the optical axis between the beam projecting device P and the beam receiving device R can be accomplished efficiently in the matter of minutes. Specifically, since the horizontal angle adjusting knob 8 is positioned below the corresponding optical unit 14 and the vertical angle adjusting knobs 13 are positioned laterally of the optical unit 14, the optical unit 14 will in no way be blocked by the attendant worker's hands during the adjustment being performed and, therefore, there is no possibility that the attendant worker's hands will disturb any of the path of travel of the infrared beam and the field of view of the sighting device. Accordingly, the attendant worker can easily perform the adjustment of the optical axis in his comfortable posture while looking through one of the eyepiece windows 34 of the sighting device 33.

Also, since change of any of the horizontal and vertical angles of the optical unit 14 is accomplished by means of the adjusting knobs 8 and 13, the beam projecting device P embodying the present invention is extremely easy to operate as compared with the conventional device requiring the use of a screwdriver to turn the adjustment screw and, thus, a quick manipulation of the beam projecting device P is possible.

Further, since the drive gears 29 and the driven gears 39 meshed therewith, respectively, rotate in the same direction, the direction in which the adjusting knobs 8 and 13 are turned and the direction in which the optical units 14 are rotated remain the same regardless of whether they are associated with the upper beam projector 7 or whether they are associated with the lower beam projector 7, even though the upper and lower beam projectors 7 are positioned in a fashion inverted relative to each other. Accordingly, there is no possibility that the attendant worker may perform an erroneous operation to rotate the optical units 14 in the wrong direction. Also, the attendant worker when ascertaining with his or her naked eyes the position of the stopper pieces 40 , exposed to the outside, within the respective arcuate engagement slots 28 can grasp at a glance the approximate vertical angle at which each of the optical units 14 being then adjusted is held. Accordingly, the attendant worker can efficiently perform the adjustment of the angle of each of the optical units 14.

After the fine adjustment to align the optical axis of the beam projecting device P has completed, a similar procedure is carried out to the beam receiving device R. Even when the fine adjustment to align the optical axis of the beam receiving device R is performed, effects similar to those brought to the beam projecting device P can be equally obtained.

Since the beam projecting device P discussed above is specifically of the structure in which the vertical angle of the optical units 14 can be varied by manually turning the vertical angle adjusting knobs 13 to cause the drive gear 29 to drive the driven gear 39 meshed with the drive gear 29, the beam projector 7 has a shape determined by the diameter of each of the gears 29 and 39. Accordingly, even where the angle over which each of the optical units 14 is tilted is desired to be large, for example, about 90°, there is an advantage in that a drive mechanism including the gears 29 and 39 will not increase in size.

Figure 4:
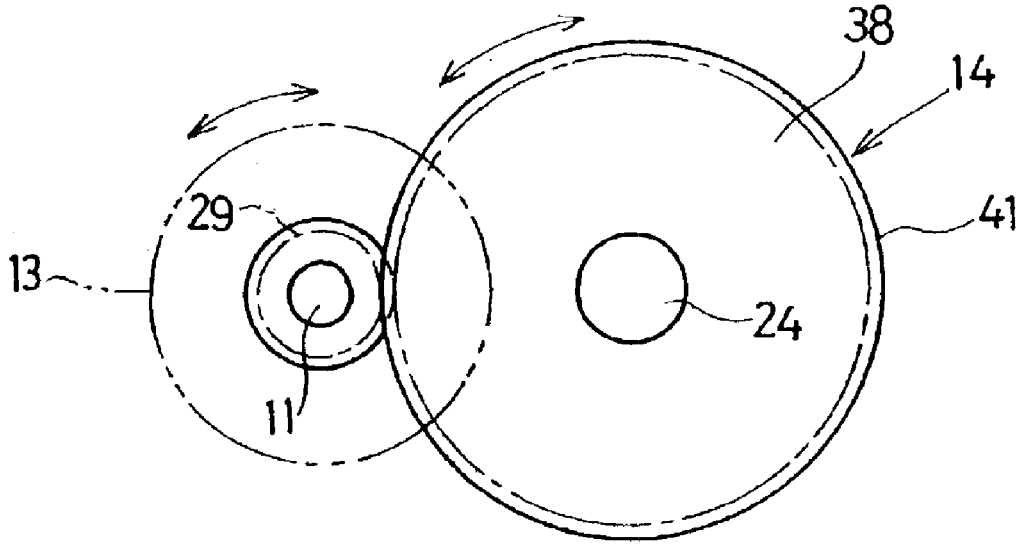
FIG. 4 is a schematic right-hand side view of an important portion of the beam projecting device according to a second preferred embodiment of the present invention.
Figure 5A:
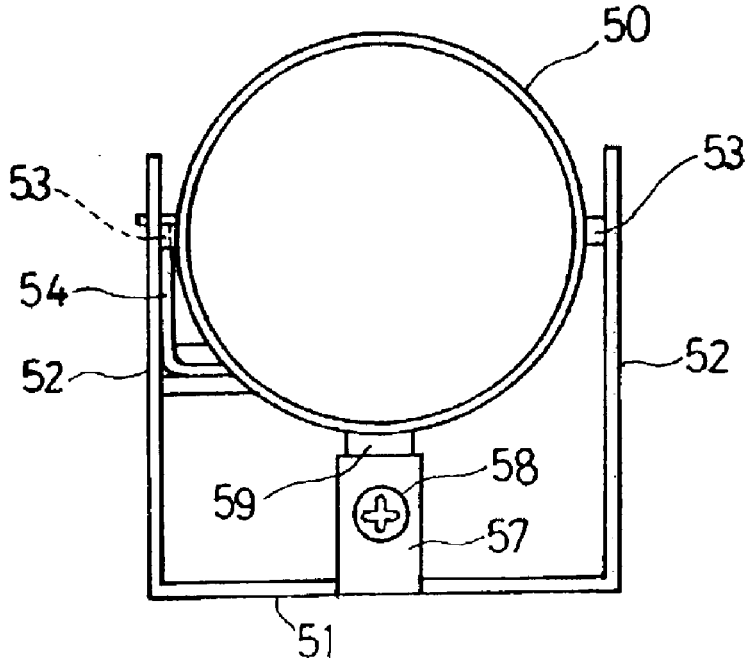
PRIOR ART Fig. 5A
FIGS. 5A and 5B are schematic front elevational and right-hand side views, respectively, showing an important portion of the conventional anti-thief security sensor assembly.
Figure 5B:
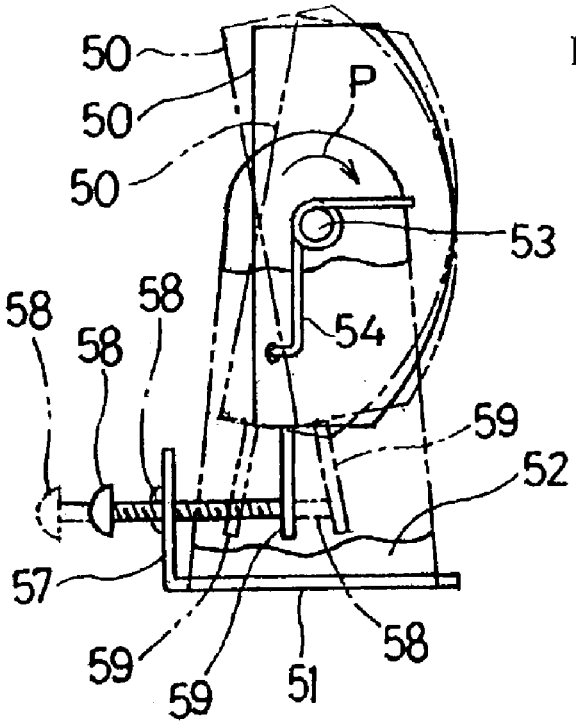
Fig. 5B PRIOR ART

FIG. 4 schematically illustrates an important portion of the beam projecting or receiving device that forms an anti-thief security sensor assembly according to a second preferred embodiment of the present invention. Component parts shown in FIG. 4 similar to those shown in FIG. 3 are designated by like reference numerals used in FIG. 3 and, therefore, the detailed description thereof are not reiterated for the sake of brevity. In this anti-thief security sensor assembly shown in FIG. 4, in place of the driven gear 39 in the form of the internally threaded gear, a driven gear 41 in the form of an externally threaded gear is provided in the passive portion 38 of the optical unit 14 for engagement with the drive gear 29. Other structural features of the anti-thief security sensor assembly according to this embodiment are similar to those shown and described in connection with the first embodiment.

According to the second embodiment, although the direction in which the vertical angle adjusting knob 13 is turned and the direction in which the optical unit 14 is turned are reverse to each other, this remains the same so far as the upper and lower beam projectors 7 positioned in a fashion inverted to each other are concerned. In other words, even in any one of the upper and lower beam projectors 7, the optical units 14 can turn in a direction reverse to the direction in which the vertical angle adjusting knobs 13 are turned. For this reason, there is no risk of an erroneous operation being performed when the attendant worker attempts an adjustment of the vertical angle of the optical unit 14 in each of the beam projectors 7.

It is to be noted that if one of the upper and lower beam projectors 7 employed in the beam projecting device P in the foregoing embodiment is replaced with a beam receiver, the resultant device will be a beam projecting and receiving device. Accordingly, an anti-thief security system can be configured if the beam projecting and receiving device is installed at each end of the guard area. It is also to be noted t hat an anti-thief security sensor assembly of a reflecting type can be configured if the beam projector and the beam receiver are housed within a single casing. In other words, the present invention is also directed to the anti-thief security sensor assembly of any of the beam projecting and receiving type and the reflecting type.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. An anti-thief security sensor assembly for detecting an intruder by means of a detecting wave, said security sensor assembly including:

a support member fitted to a device body;

an optical unit for projecting or receiving the detecting wave, said optical unit being mounted at its lateral sides on the support member for rotation about a horizontal pivot axis;

a drive gear rotatably mounted on the support member and positioned laterally of the optical unit, said drive gear capable of being turned manually; and a driven gear mounted on a lateral side of the optical unit and drivingly meshed with the drive gear, said driven gear being rotatable together with the optical unit about a horizontal pivot axis.

2. The security sensor assembly as claimed in claim 1, wherein the drive gear is an externally threaded gear and the driven gear is an internally threaded gear.

3. The security sensor assembly as claimed in claim 1, further comprising a stopper piece provided on the lateral side of the optical unit and wherein the support member has an engagement slot defined therein, said engagement slot receiving the stopper piece therein while allowing the stopper piece to be exposed laterally outwardly from the optical unit, said stopper piece and said engagement slot cooperating with each other to define an angle over which the optical unit can be rotated about the horizontal pivot axis.

4. The security sensor assembly as claimed in claim 1, wherein the drive gear is rotatably supported by the support member and is coaxially provided on a vertical angle adjusting knob having an outer peripheral surface knurled to have surface indentations.

5. The security sensor assembly as claimed in claim 1, wherein the support member is mounted on the device body for rotation about a vertical pivot axis.

6. The security sensor assembly as claimed in claim 5, wherein the support member is of a generally U-shaped configuration having a base plate and a pair of support arms, said support arms extending from opposite ends of the base plate at right angles thereto, respectively, and wherein the optical unit is supported by the support arms.

7. The security sensor assembly as claimed in claim 6, wherein the base plate has an internally threaded gear and further comprising a vertical angle adjusting knob supported by the device body for rotation about the vertical pivot axis, the vertical angle adjusting knob having an outer peripheral surface knurled to provide surface indentations, and an externally threaded gear provided coaxially on the horizontal angle adjusting knob and drivingly meshed with the internally threaded gear.

8. The security sensor assembly as claimed in claim 1, wherein the drive gear and the driven gear are externally threaded gears.

9. The security sensor assembly as claimed in claim 1 further including an eyepiece positioned on a lateral side of the optical unit to permit relative alignment of the optical unit by an operator without blocking an optical axis of the optical unit.

10. The security sensor assembly as claimed in claim 9 further including a second optical unit for projecting or receiving the detecting wave with a second eyepiece positioned on a lateral side of the second optical unit.

* * * * *